US010458062B2

(12) United States Patent
Franchetti

(10) Patent No.: US 10,458,062 B2
(45) Date of Patent: Oct. 29, 2019

(54) METHOD FOR TREATING TEXTILE MATERIAL AND CORRESPONDING TREATMENT APPARATUS

(71) Applicant: REGGIANI MACCHINE SPA, Grassobbio (IT)

(72) Inventor: Roberto Franchetti, Vicenza (IT)

(73) Assignee: REGGIANI MACCHINE SPA, Grassobbio (IT)

( * ) Notice: Subject to any disclaimer, the term of this patent is extended or adjusted under 35 U.S.C. 154(b) by 247 days.

(21) Appl. No.: 15/036,632

(22) PCT Filed: Nov. 14, 2014

(86) PCT No.: PCT/IB2014/066035

§ 371 (c)(1),
(2) Date: May 13, 2016

(87) PCT Pub. No.: WO2015/071862

PCT Pub. Date: May 21, 2015

(65) Prior Publication Data

US 2016/0289892 A1 Oct. 6, 2016

(30) Foreign Application Priority Data

Nov. 14, 2013 (IT) ..... UD2013A0150

(51) Int. Cl.

| | |
|---|---|
| ***D06P 5/20*** | (2006.01) |
| ***D06B 9/02*** | (2006.01) |
| ***D06B 19/00*** | (2006.01) |
| ***D06L 4/70*** | (2017.01) |
| ***D06C 7/00*** | (2006.01) |

(52) U.S. Cl.

CPC ..... *D06P 5/2055* (2013.01); *D06B 9/02* (2013.01); *D06B 19/0076* (2013.01); *D06C 7/00* (2013.01); *D06L 4/70* (2017.01); *D06P 5/2066* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 1,513,306 | A * | 10/1924 | Baxter | D06P 5/001 | 428/195.1 |
| 4,057,864 | A * | 11/1977 | Wild | B41F 16/02 | 101/472 |
| 5,173,980 | A | 12/1992 | Riedel | | |
| 6,381,883 | B1 * | 5/2002 | Le | D06C 7/00 | 38/49 |

FOREIGN PATENT DOCUMENTS

| | | | | |
|---|---|---|---|---|
| EP | 1816249 | * | 1/2007 | |
| EP | 1816249 | * | 8/2007 | D06C 7/00 |
| EP | 1816249 | A2 | 8/2007 | |
| GB | 729353 | A | 5/1955 | |

* cited by examiner

*Primary Examiner* — Amina S Khan
(74) *Attorney, Agent, or Firm* — King & Schickli, PLLC

(57) ABSTRACT

A method for treating textile material (13) to attach dyes, such as synthetic or natural dyes, or to apply bleaches to said textile material (13). The method provides a first step of pre-impregnation of the textile material (13) with an impregnation liquid and a second step of heating the impregnation liquid and the possible dyes or bleaches, through contact of said textile material (13) with at least one heated drum (20), and subsequent vaporization of said impregnation liquid, said textile material (13) being selectively movable on said heated drum (20), subjected to an adjustable pressure higher than atmospheric pressure, a strip (18) being present and exerting on said textile material (13) an adjustable pressure against the heated drum (20).

13 Claims, 2 Drawing Sheets

METHOD FOR TREATING TEXTILE MATERIAL AND CORRESPONDING TREATMENT APPARATUS

This application is the national stage of PCT/IB2014/066035, filed Nov. 14, 2014, which claims priority from Italian Application No. UD2013A000150, filed Nov. 14, 2013.

FIELD OF THE INVENTION

The present invention concerns a method for treating textile material, such as a fabric, knitwear or non-woven fabric, to attach dyes, such as synthetic or natural dyes, or to apply bleaches to the textile material.

The invention also concerns the corresponding treatment apparatus.

BACKGROUND OF THE INVENTION

Textile printing is a localized dyeing, with one or two colors, of textile materials, such as fabrics, knitwear or non-woven fabrics, which allows to make drawings, writings, artistic representations or suchlike.

Printed textile fibers can be, for example, cellulose, animal, artificial or synthetic fibers and corresponding mixes thereof.

The dyes used can be the synthetic or natural type.

The synthetic dyes used can be reactive, direct, vat, acids, metalized acids, basic, disperse, corrodable dyes or pigments.

Natural dyes can be vegetable, animal or mineral in origin.

Textile printing provides to apply a printing paste of dyes or pigments and possible chemical auxiliaries to the textile material.

The printing paste can contain, as well as the dyes, also thickeners, hygroscopic or hydrotropic substances, such as for example urea, reagents such as for example acids, alkalis, reducers, sequestrants and various possible auxiliaries.

The application of printing paste can be made using square frames or engraved hollow cylinders.

A textile printing of the digital type is also known, in which a colored ink is applied on the textile material previously impregnated with the printing paste.

Following the application of the printing paste, mixed with the dyes and the corresponding chemical auxiliaries, the fabric is dried in controlled conditions so as not to alter the products applied.

Subsequently, a vaporization step is carried out, generally continuously at a temperature of 100° C. with saturated steam, on the dry printed support, so as to stably attach the dyes to the fiber.

During vaporization, the dye spreads in the fiber and is attached there, with the aid of the corresponding chemical auxiliaries.

The dye spreads, in particular, either with the action of the percentage of condensed water on the fiber, combined with that of the ambient heat, or simply through the intervention of the heat if super-heated steam is used.

The reduced percentage of water that condenses on the fiber depends on the temperature of the material entering, on the type of fiber and the presence of hydrotropic substances such as urea.

Vaporization with super-heated steam at a temperature of 150° C.-200° C. is applied with the purpose of attaching the prints consisting of disperse dyes applied to synthetic fibers, artificial fibers and possibly cellulose fibers or for pigment printing.

The most widespread vaporization apparatuses, commonly called vaporizers, are the continuous type, where the textile material travels as a suspended band.

Some disadvantages of using current vaporizers working continuously at atmospheric pressure are: poor yield of the dyes, long times required for attaching the dyes, for example 10-15 minutes in the case of reactive dyes applied to cotton, high consumption of printing paste and chemical auxiliaries, high consumption of urea, which is a highly polluting agent, high consumption of water in the washing step after vaporization.

Other disadvantages of current vaporizers are: high consumption of steam, formation of drops with consequent smearing of the print, delicate and difficult management of the apparatus.

In order to increase the dye yield positively on all types of fibers, thanks to the greater quantity of water that condenses on the fibers and to the high temperature, vaporization can be carried out under high pressure conditions, for example, adjustable up to 5 atmospheres and with a maximum temperature of about 150° C.

In this respect, HP (or high pressure) vaporizers are known, or star vaporizers, which work discontinuously, and HP machines that work continuously.

One disadvantage of HP star vaporizers is that they have very low productivity.

In the case of continuous HP machines, the dye yield is excellent but there are problems regarding the leakage of steam from the mechanical seals mounted at entrance/exit of the machine, which is risky for the users: there are also problems regarding wear on the seals, corresponding safety problems, cost and complexity of the machine.

In continuous dyeing or bleaching techniques the pad steam method is known, where the dyes or bleaching products are applied on the textiles using a "foulard" type device; they are then attached to the fibers using vaporization performed at a temperature of 100° C.

The counter-indications of this technique are: poor dye yield, need to have big lengths, high consumption of chemical auxiliary agents, high consumption of steam and water as well as the cost of the plant.

Document GB 729 353 A describes a method for attaching dyes applied on the textile material by means of a foulard type device, where the fabric enters between a felt and a heated drum. The heat vaporizes the liquid carried by the fabric; between the felt that is impermeable to steam and the hot surface of the drum, an environment is created at a temperature of about 100° C. The counter-indications of this technique are: poor dye yield, impossibility of attaching disperse dyes to polyester and limited processing speed.

Document U.S. Pat. No. 4,057,864 describes a print transfer method of the wet type. In this case, the textile material, previously wet, enters together with the transfer paper between an impermeable felt and a heated drum. The steam vaporizes the liquid carried by the fabric, so as to guarantee transfer of the dye from the printed paper to the textile material with subsequent attachment thereof to the fibers. To guarantee a steam atmosphere of above 100° C., on the external part of the strip a series of squeezer rollers are installed, which can exert, in the various points of contact with the strip, a high adjustable pressure such as to generate, in said points of contact, a steam environment with a pressure above atmospheric pressure. The counter-indications of this technique are: reduced contact surface between squeezer rollers and strip under high pressure conditions, so that the working speed is limited.

Document U.S. Pat. No. 5,173,980 describes a continuous decatizing method for wool fabrics. In this document, a humidified fabric enters between an impermeable felt and a hot drum. To vaporize the liquid in the fabric at a high temperature, higher than atmospheric temperature, a high longitudinal tension is applied to the impermeable strip. The counter-indications of this technique are: the non-uniform pressure of the strip against the textile material, which is considerably higher in the side opposite the tension system so that the temperature of the steam generated is also not uniform; the deformation of the strip and its rapid deterioration, which thus requires considerable maintenance.

Purpose of the present invention is to obtain a method for treating textile material that is quick and economical, and a corresponding treatment apparatus, to attach the dyes or bleaches on every type of textile material under conditions of homogeneous and adjustable pressure higher than atmospheric pressure, which is safe for users.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

The present invention concerns a method for treating textile material in order to attach dyes, such as synthetic or natural dyes, or to apply bleaches to said textile material, and a corresponding treatment apparatus.

The treatment method provides:

- a first step of pre-impregnation of the textile material with an impregnation liquid, in which the impregnation liquid can be, depending on the cases, only water, a water solution containing dyes, or a water solution containing bleaches, or a solution containing chemical auxiliaries, or other suitable impregnation liquid such as a solvent;
- a second step of heating the impregnation liquid and possible dyes or bleaches or chemical auxiliaries, through contact of said textile material with at least one heated drum, and subsequent vaporization, under pressure conditions higher than atmospheric pressure, of said impregnation liquid, said textile material being movable around said heated drum and subjected to an adjustable pressure higher than atmospheric pressure, an impermeable strip being present exerting an adjustable pressure from the outside on said textile material against said heated drum.

The impermeable strip has the function of keeping the textile material in contact with the surface of the heated drum with an adjustable pressure.

The homogeneously distributed pressure of the impermeable strip against the textile material is guaranteed in its turn by the pressure exerted by a pressurized gaseous compartment, with a pressure higher than atmospheric pressure, against said strip in its transit step inside a chamber disposed around at least a portion of the heated drum.

The pre-impregnation of the textile material, before its contact with the heated drum, and the subsequent heating by the heated drum, allow to reduce costs compared to known vaporizers, since the heating and subsequent vaporization of the impregnation liquid occur thanks to the contact of the textile material with a heated surface, the textile material being subjected to an adjustable pressure, avoiding the need to use other steam generators.

The treatment method according to the present invention also has the following advantages:

- high degree of attachment of the dye to every type of fiber, even in the case of materials which are difficult to treat such as polyester or synthetic fibers;
- high dye yield,
- increased brightness of the color;
- attachment of the dye to the textile in a shorter time;
- uniform attachment of the dye;
- reduction in yellowing of the fibers;
- no smearing of the print;
- low consumption of chemical auxiliaries and print thickeners;
- total or almost total elimination of the urea,
- reduced consumption of steam;
- reduced consumption of water in subsequent washing after printing;
- ease of management.

The method for attaching dyes to fibers allows to obtain a high dye yield thanks to two fundamental points: the adjustable quantity of impregnation liquid applied to the textile and the subsequent high vaporization temperature of said liquid.

Between the strip, which is impermeable to the steam, and the hot surface of the heated drum, for example, with a self-regulated temperature, a steam compartment is created which can be maintained at a pressure higher than atmospheric pressure thanks to the adjustable counter pressure exerted by the strip itself.

The compression action of the impermeable strip against the impregnated textile, to which the marked heat effect is added, promotes:

- the breaking of the hydrogen bridges between the macromolecules of the fibers;
- the dissolution of the dyes and corresponding auxiliaries in the liquid part;
- the transport and diffusion of the dye, and development of its reactions with the fibers;
- the attachment of the dye to the fibers in a few seconds;
- a high dye yield;
- the development of the patterns without widening the printing contours.

According to the present invention, the textile material can be previously printed, in which case the impregnation liquid can be only water, or it can be raw textile material, in which case the impregnation liquid will contain dyes and/or bleaches and/or chemical auxiliaries.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
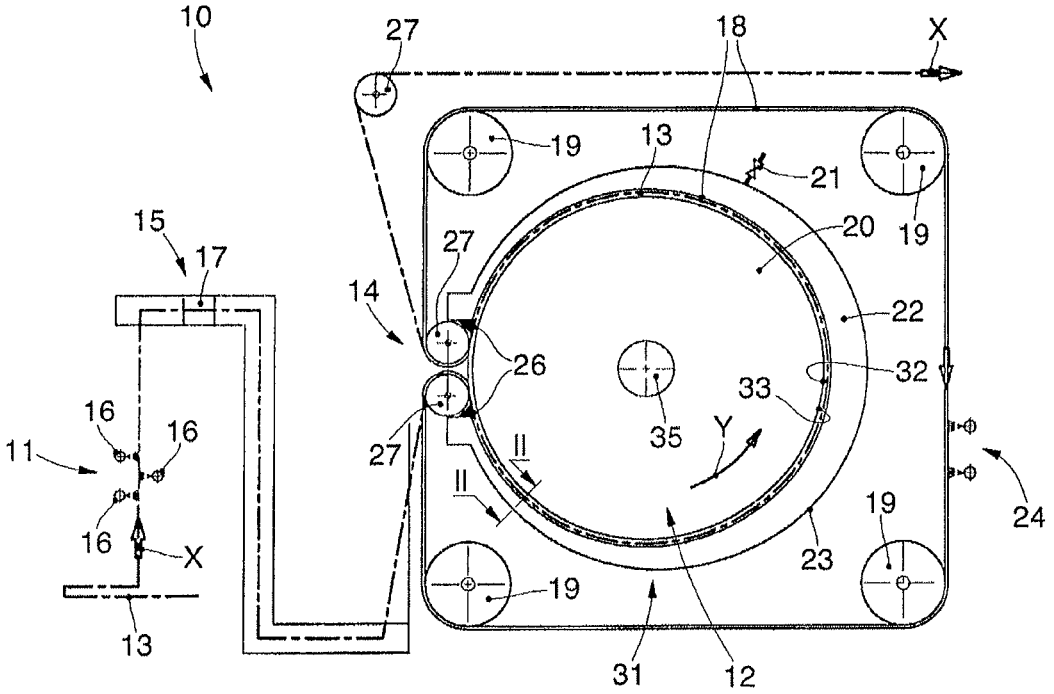
FIG. 1 is a form of embodiment of an apparatus for treating textile materials according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Figure 2:
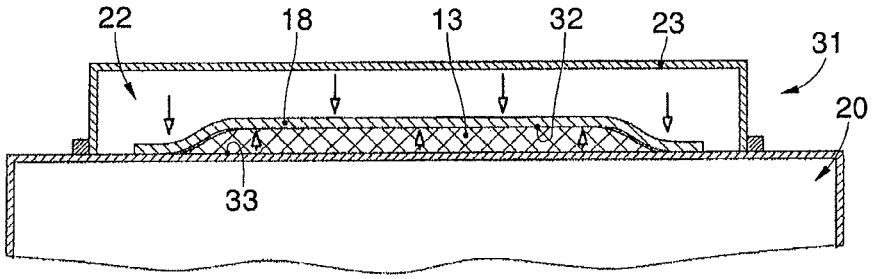
FIG. 2 is an enlarged detail seen in section from II to II.
Figure 3:
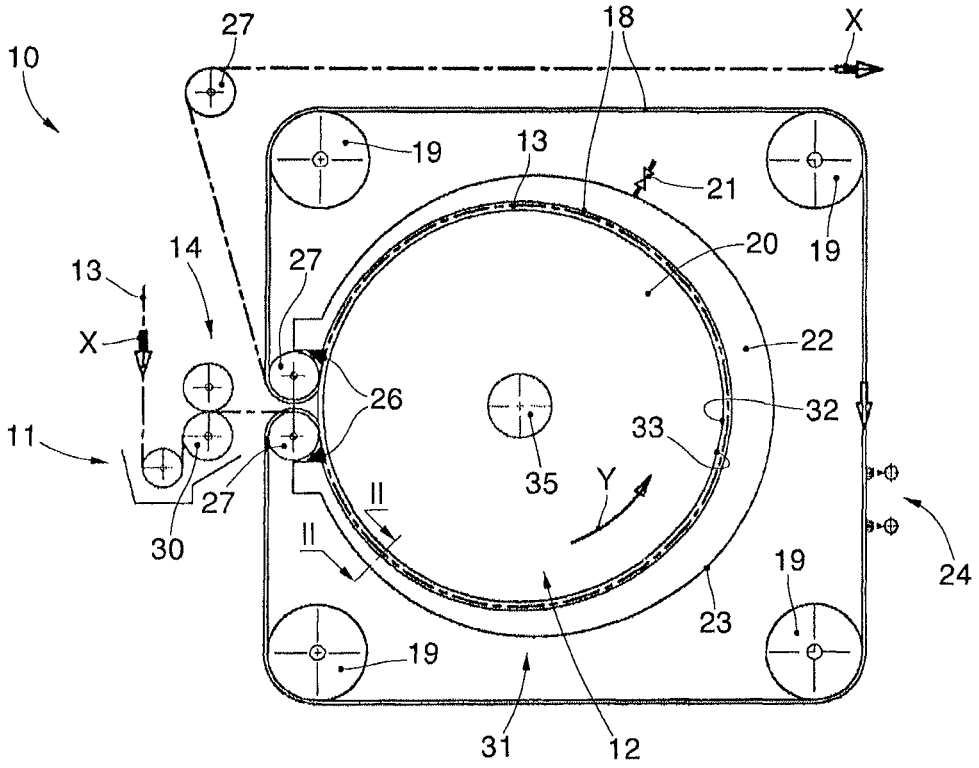
FIG. 3 is another form of embodiment of an apparatus for treating textile materials according to the present invention.

FIGS. 1 to 3 are used to describe an apparatus for treating a textile material 13 to attach dyes, such as synthetic or natural dyes, or the application of bleaches to said textile material 13.

The textile material 13 can consist for example of cellulose, animal, artificial or synthetic fibers, and corresponding mixtures thereof.

The textile material 13, during the treatment of the treatment apparatus 10, can have an elongated form chosen for example from a fabric, knitwear, a non-woven fabric, yarns, tops or also tows.

The treatment apparatus 10 comprises a pre-impregnation member 11 to impregnate the textile material 13 with an impregnation liquid, a movement unit 14 to move the textile material 13 and a pressurization member 31 configured to establish a pressure greater than atmospheric pressure.

In the form of embodiment in FIGS. 1-3, in particular, the treatment apparatus 10 is used as a vaporizer, to take the impregnation liquid to vaporization temperature, also raising the temperature of fibers, dyes, bleaches, or possible chemical auxiliaries to allow attachment of the dyes or treatment with bleaches. In this case, the textile material 13 arriving at the pre-impregnation member 11 can be covered with printing paste, deposited and dried in previous working steps, not shown.

The impregnation liquid can be, for example, water or a water solution containing chemical auxiliaries, such as for example alkalis, acids, reducers or also solvents.

The impregnation liquid of the textile material 13, taken to a pressure higher than atmospheric pressure and to the consequent high temperature, allows to attach the dyes present in the printing paste in a very short time.

In forms of embodiment described with reference to FIG. 1, the pre-impregnation member 11 comprises sprayers 16 to deliver the impregnation liquid onto the textile material 13.

In other forms of embodiment, the pre-impregnation member 11 can include a foulard type device 30 (FIG. 3), brushes, devices with a continuous jet, spreader cylinders for the felt strip, kept damp, a suction bar or other similar systems.

The pre-impregnation member 11 can also include tubes, one or more heat exchangers, systems to control the temperature of the liquid, connectors and transport pipes of the impregnation liquid, not shown in the drawings.

In the case of a printing paste containing dyes and corresponding chemical auxiliaries, the textile material 13 can, for example, be dampened by the sprayers 16, with an impregnation liquid consisting of only water, while in the case of a printing paste containing only or mainly dyes, the textile material 13 can be dampened with a water solution containing the corresponding chemical auxiliaries, necessary to attach the dyes to the fibers.

The treatment apparatus 10 can comprise, for example, monitoring means 15 to detect parameters concerning at least the impregnation by the pre-impregnation member 11 or the heating by the heating member 12.

The monitoring means 15, in the form of embodiment in FIG. 1, comprise a detector 17 to detect the quantity of impregnation liquid deposited on the textile material 13.

In some forms of embodiment, the detector 17 allows to regulate, for example with a counter reaction mechanism, the quantity of impregnation liquid delivered by the sprayers 16 to obtain a determinate quantity of impregnation liquid in relation to the weight of the textile material 13.

The ratio between the weight of the impregnation liquid and weight of the fabric 13 is called humidification quantity, for example quantifiable on a percentage base.

The percentage of humidification can be chosen, for example, in relation to the type of fiber, to the weight of the textile material 13, to the class of dyes, to the surface or in-depth attachment of the dyes in the textile material 13 or to the intensity of the print colors.

The percentage of impregnation liquid added to the textile material 13 with the raising of its temperature is decisive for melting the dyes and then, with the help of the corresponding chemical auxiliaries, for attaching them to the fibers.

By way of example, in the case of a light article made of cotton with very light print intensity, a quantity of humidification of about 10%-20% will be sufficient. In the case of a heavy article, also made of cotton with very dark print intensity, the percentage of humidification will rise to 50-80%. In the case of a heavy article made of polyester it may be convenient to have a high quantity of humidification, even from 50-100%, to soften the fibers, for example, at a temperature of about 150° C. in high pressure conditions, to allow the disperse dyes to penetrate into the very heart of the fibers of the textile material 13.

The heating member 12 comprises at least a heated drum 20, cylindrical in shape, configured to be taken to a determinate temperature, for example, adjustable from about 100 to about 180° C., heating and/or vaporizing the impregnation liquid in the textile material 13, entering into contact with the textile material 13 itself.

The heated drum 20 comprises, in this case, an external surface, or covering surface 32, that can be, by way of example, smooth and made of steel, sanded and made of steel, Teflon-covered, rubber-coated or provided with another covering.

The treatment apparatus 10, in the form of embodiment of FIGS. 1-3, comprises a movement unit 14 to move the textile material 13 which comprises drive rollers 27 to move the textile material 13 entering and exiting from the machine 10, through suitable seals 26, and tensioning rollers 19 to keep an impermeable strip 18 under tension.

The treatment apparatus 10 also comprises a pressurization member 31, which can achieve a homogeneous and adjustable pressure on the textile material 13 higher than atmospheric pressure, for example from about 0.1 to about 10 $kgs/cm^2$.

Thanks to the pressure exerted on the outside of the textile material 13 while it is wound around the heated drum 20, the pressurization member 31 can allow to vary the vaporization temperature of the impregnation liquid.

In the forms of embodiment shown in FIGS. 1-3, the pressurization member 31 comprises the impermeable strip 18 for the sliding of the textile material 13, and a chamber 23 defining an internal compartment 22 and configured to take the strip 18 under pressure, that is, a pressure higher than atmospheric pressure, against the heated drum 20.

The strip 18 typically has a width greater than the width of the textile material 13, as shown in FIG. 2, thus guaranteeing the sealing of the textile material 13 and the compartment 22.

The inside of the chamber 23 is a pressurized compartment 22 of inert gas, for example air or nitrogen, or helium or even a mix of inert gases, which exerts an adjustable and homogeneous pressure against all the strip 18 in transit inside the chamber 23 positioned around the heated drum 20.

The possible leakages of inert gases are not dangerous for the work environment and this is advantageous, given the difficulty in guaranteeing the total hermetic seal of the chamber 23.

The lost gas exiting from the seals 26 can be reintegrated by an equal quantity of new compressed gas, innocuous for the health, entering by means of a top-up tube 21 so as to keep the pre-set pressure of the compartment 22 always constant.

The strip 18 can be, by way of example, made of metal, such as steel, or a polymeric material or a fabric or felt.

In accordance with the form of embodiment shown in FIG. 2, the strip 18 can have a covering surface 32, for example made of rubber, Teflon or silicone.

The covering surface 32 in this case enters into contact with the textile material 13 and can preferably be configured to resist to a temperature up to 180° C.

In the form of embodiment in FIG. 1, the strip 18 is a closed ring and guided by the tensioning rollers 19, as shown in FIGS. 1 and 3.

In other forms of embodiment the strip 18 can have dedicated movement means.

In alternative forms of embodiment, not shown, the strip 18 can be progressively wound on suitable rollers; the strip 18, rolled up after its transit inside the chamber 23, can be subsequently reused on entering the same chamber 23, possibly following the route in the opposite direction. In this case the strip 18 can be as long as thousands of meters.

At entrance/exit the chamber 23 can comprise a plurality of seals 26, made in a known way, which can be rotating or can be inflatable and slide directly against the strip 18 or, in another alternative solution, partly against the strip 18 and partly against the heated drum 20. In another alternative solution, the inflatable sliding seals 26 can be positioned around the whole perimeter of the chamber 23.

The method for treating the textile material 13 using the treatment apparatus 10 in FIGS. 1-3 provides a first step of pre-impregnating the textile material 13 with a set percentage of impregnation liquid, and a second step of heating the impregnation liquid present in the textile material 13 by contact with at least a heated drum 20, said textile material 13 being mobile and guided around said heated drum 20, subjected to an adjustable pressure higher than atmospheric pressure, a strip 18 being present exerting an adjustable pressure from the outside on said textile material 13 against said heated drum 20.

Thanks to this configuration, the heated pre-impregnation liquid will develop a temperature and a pressure of steam higher than atmospheric pressure, thanks to the mechanical pressure, adjustable and homogeneously distributed exerted on the textile material 13 by the impermeable strip 18, which in its turn is subjected to the pressure exerted on it by the pressurized internal gaseous compartment 22 of the chamber 23.

However, advantageously, the homogeneous pressure exerted by the pressurized internal gaseous compartment 22 inside the chamber 23 against the impermeable strip 18 is greater than the pressure of the steam generated between the strip 18 and the heated drum 20 by an adjustable value from 0.1 atm to 10 atm.

The textile material 13 is moved by the movement unit 14 with a selectively adjustable speed, through the pre-impregnation member 11 and subsequently into the heating member, preferably with the printed side against the impermeable covering surface 32 of the strip 18 and the heated drum 20 or in an alternative solution with the printed side of the textile material 13 in contact against the heating surface 33 of the heated drum 20, kept, for example, at a uniform and adjustable temperature up to a maximum of 180° C.

In some forms of embodiment, the pre-impregnation step provides the textile material 13 with a humidification percentage of the impregnation liquid comprised between 10% and 100%.

In some forms of embodiment the adjustable pressure of the impermeable strip 18 against the textile material 13 is homogeneous and comprised between 0.1 kg/cm$^2$ and 10 kg/cm$^2$.

The heated drum 20, in this case, has on its heating surface 33 a pre-determined temperature kept homogeneous, and the strip 18 is kept adhering against the textile material 13 by an adjustable and homogeneous pressure exerted, on the opposite side of the strip 18, in particular by the pressurized compartment 22.

In some forms of embodiment, the temperature of the drum 20 is homogeneous and adjustable from 100° to 180°.

The heat yielded to the textile material 13, from contact with the heating surface 33 of the heated drum 20, quickly heats the impregnation liquid contained inside the textile material 13, all the fibers and all the dyes with the corresponding chemical auxiliaries, and generates an environment of saturated steam at an adjustable pressure and temperature.

In practice, between the heated drum 20 and the strip 18 an environment of saturated steam is generated, with an adjustable temperature higher than that of atmospheric temperature.

The movement unit 14 allows the movement of the textile material 13 in a direction X.

In this case, the drive rollers 27 drive the movement of both the textile material 13 and the strip 18, facilitated by the action of the tensioning rollers 19.

Moreover, the heated drum 20 is made to rotate around its pin 35 in the direction of rotation Y.

The textile material 13, already covered with printing paste containing the dyes, is dampened with a percentage of humidity regulated in relation to the fibers, to the weight of the textile material 13, to the intensity of the print and to the class of dyes, with water or a water solution of chemical auxiliaries.

For example, the heating surface 33 maintained at a temperature of 102° C. generates inside the fibers of the textile material 13 an absolute pressure of saturated steam of approximately 1.1 atm, the heating surface 33 maintained at a temperature of 120° C. generates inside the fibers a pressure of saturated steam of approximately 2 atm, the heating surface 33 maintained at a temperature of 150° C. generates inside the fibers a pressure of saturated steam of approximately 4.9 atm.

In particular, in correspondence to each determinate pressure, the impregnation liquid present in the fibers and the steam generated have the same temperature corresponding to the relative pressure, as per the law of physics.

To regulate the pressure of the saturated steam and its equivalent temperature generated inside the fibers, it is necessary to regulate the pressure of the compartment 22 which, to keep the strip 18 sealed against the surface 33 of the heated drum 20, can be equal to but advantageously higher by about 0.1-1 atm than the equivalent pressure of the steam generated inside the textile material 13. In practice, regulating the temperature of the heating surface 33 of the heated drum 20 and the pressure of the compartment 22, it is possible to regulate the temperature of the impregnation liquid contained in the textile material 13 with its corresponding vaporization pressure, but also the temperature of the fibers, of the dyes and the chemical auxiliaries.

The temperature of the steam generated starting from the impregnation liquid present inside the fibers of the textile material 13 can be regulated from 100° C. to 170° C., more preferably around 120° C.-150° C.

The pressure of the compartment 22 inside the chamber 23 can be regulated from 1 atm up to a maximum indicative value of 8-10 atm.

The rapid heating and vaporization of the impregnation liquid, such as, for example a water solution containing chemical auxiliaries, at an adjustable pressure advantageously higher than atmospheric pressure, the heating of the printing paste containing the dyes and the heating of the textile material 13 itself, promote the diffusion and the attachment of said dyes to the fibers of the textile material 13 within a few seconds, even in the case of polyester fibers, whose treatment should preferably provide that the pressure of the steam developed inside the fibers is about 5 atm.

In the example case of a textile material 13 made of cotton, the pressure developed will be about 2 atm. In the case of a particularly delicate textile material 13 such as silk or wool, a slightly higher than atmospheric pressure is used, for example 1.01 atm.

The vaporization pressure of the impregnation liquid contained in the textile material 13 and the equivalent temperature will be chosen on the basis of the type of textile material 13 and on the class of dyes.

Since in this case the textile material 13 is kept between the heated drum 20 and the strip 18, the risk of smearing of the print is reduced.

If the printed side of the textile material 13 is disposed in contact with the covering surface 32, every time the strip 18 exits from the chamber 23 it is washed by washing means 24 in order to eliminate possible deposits of printing paste or dyes, so that it will be clean, dry or moist, at its new transit inside the chamber 23.

If the printed side of the textile material 13 is disposed in contact against the heated drum 20, means for cleaning the heated drum 20 can be provided, such as sprayers, which will be conveniently mounted between the seals 26 at entrance to the chamber 23.

In some forms of embodiment both the cleaning means for the heated drum 20 and the washing means 24 for the strip 18 can be provided, for example in the case of printing very intense colors.

With reference to the form of embodiment in FIG. 3, the pre-impregnation member 11 supplies an impregnation liquid comprising water, chemical auxiliaries and dyes that will be attached to the fibers of the textile material 13 with the technique of the method described above.

The dyes can be of various types, including indigo dye, for example, present in a water solution that will impregnate the textile material 13 (fabrics, non-woven fabrics, knitwear, yarns, tops or also tows).

The pre-impregnation member 11 in this case comprises a foulard 30 which allows an adjustable pick-up that can reach 50%-100%.

In some forms of embodiment, combinable with the previous ones, the pre-impregnation member 11 can deliver a water solution containing bleach products.

In this case the textile material 13 (fabrics, non-woven fabrics, knitwear, yarns, tops or also tows) can be impregnated with a pick-up of 50%-100% guaranteed by the foulard 30, so as to guarantee bleaching with the technique of the method described above.

The treatment apparatus 10 can provide treatment and sandwich movement of one or various textiles 13 or articles.

In some forms of embodiment a plurality of heated drums 20 can be provided, for example, positioned one after the other to guarantee a high production speed.

According to a variant, a roll of already printed paper can be provided, not shown, for the transfer of dyes to be attached.

The roll of paper with dyes is moved in parallel together with the textile material 13 inside the chamber 23 with the printed side of the paper facing against the textile material 13. The textile material 13 and the printed paper are substantially kept pressed against the heated drum 20 by the strip 18.

The impregnation liquid, containing possible chemical auxiliaries, present in the textile material 13 is heated and vaporized at the pre-set temperature and pressure so as to guarantee a rapid transfer of the dye from the printed paper with its subsequent attachment to the textile material 13. This technical solution guarantees an optimum printing effect with a drastic reduction of consumption of water in the subsequent washing step after printing.

In the case of printed paper with sublimation dyes, their transfer to the material can be carried out in the presence of only the relative humidity of the textile 13, which in the case of cotton is about 10%-11%.

It is clear that modifications and/or additions of parts may be made to the apparatus for the treatment of textile materials and corresponding treatment method as described heretofore, without departing from the field and scope of the present invention.

It is also clear that, although the present invention has been described with reference to some specific examples, a person of skill in the art shall certainly be able to achieve many other equivalent forms of apparatus for the treatment of textile materials and corresponding treatment method, having the characteristics as set forth in the claims and hence all coming within the field of protection defined thereby.

The invention claimed is:

1. Method for treating textile material (13) to attach dyes, such as synthetic or natural dyes, or to apply bleaches to said textile material (13), which provides:

a first step of pre-impregnation of the textile material (13) with an impregnation liquid;

a second step of heating the impregnation liquid, through contact of said textile material (13) with at least one heated drum (20), and subsequent vaporization of said impregnation liquid, said textile material (13) being movable around said heated drum (20), subjected to an adjustable pressure higher than atmospheric pressure, characterized in that it provides that:

said heated drum (20) is disposed inside a gaseous compartment (22);

an impermeable strip (18) is wound on the outside around said textile material (13) during its transit around said heated drum (20);

said internal compartment (22) is taken to a pressure higher than atmospheric pressure to exert a homogeneous and adjustable pressure against said heated drum (20) on said impermeable strip (18), and therefore on said textile material (13).

2. Method as in claim 1, characterized in that said impregnation liquid comprises water or a solvent.

3. Method as in claim 1, characterized in that said impregnation liquid comprises a water solution containing dyes and the corresponding chemical auxiliaries or a water solution containing bleaches and the corresponding chemical auxiliaries or a solution containing chemical auxiliaries.

4. Method as in claim 1, characterized in that the textile material (13) to be treated has been previously printed.

5. Method as in claim 1, characterized in that the textile material (13) to be treated is raw material.

6. Method as in claim 1, characterized in that it provides that said gaseous compartment (22) is defined by the internal environment of a chamber (23).

7. Method as in claim 1, characterized in that the homogeneous pressure exerted by the internal pressurized gaseous compartment (22) against the impermeable strip (18) is greater than the pressure of the steam generated between the impermeable strip (18) and the heated drum (20) by an adjustable value from 0.1 atm to 10 atm.

8. Method as in claim 1, characterized in that the adjustable pressure of the impermeable strip (18) against the textile material (13) during transit inside the gaseous environment (22) is homogeneously distributed and comprised between 0.1 kg/cm2 and 10 kg/cm2.

9. Method as in claim 1, characterized in that said compartment (22) contains an inert gas, harmless for the health.

10. Method as in claim 1, characterized in that the impregnation liquid comprises at least one of either:

dyes;

bleaches;

water;

chemical auxiliaries;

solvents.

11. Method as in claim 1, characterized in that the vaporization temperature of the impregnation liquid of the textile material (13) is homogeneously adjustable from about 100° C. to about 170° C.

12. Method as in claim 1, characterized in that the temperature of the heated drum (20) is homogeneous and adjustable from 100° C. to 180° C.

13. Method as in claim 1, characterized in that the textile material (13) impregnated with the impregnation liquid is conveyed between the heated drum (20) and the impermeable strip (18) together with a printed card with dyes, which gives up said dyes to the textile material (13) which are subsequently attached to said textile material (13).

* * * * *